US006145218A

United States Patent [19]

Kotitschke et al.

[11] Patent Number: 6,145,218

[45] Date of Patent: Nov. 14, 2000

[54] DRYING SECTION AND METHOD FOR DRYING A MATERIAL WEB IN SUCH A DRYING SECTION

[75] Inventors: Gerhard Kotitschke, Steinheim; Markus Oechsle, Bartholomae, both of Germany

[73] Assignee: Voith Sulzer Papiertechnik Patent GmbH, Heidenheim, Germany

[21] Appl. No.: 09/246,951

[22] Filed: Feb. 9, 1999

[30] Foreign Application Priority Data

Feb. 12, 1998 [DE] Germany ..... 198 05 723

[51] Int. Cl.[7] ..... D06F 58/00

[52] U.S. Cl. ..... 34/457; 34/117

[58] Field of Search ..... 34/443, 444, 452, 34/454, 457, 113, 114, 115, 116, 117, 124; 226/95, 97; 162/358.1, 358.3, 358.5

[56] References Cited

U.S. PATENT DOCUMENTS

| | | | |
|---|---|---|---|
| 5,371,954 | 12/1994 | Pinter et al. | 34/117 X |
| 5,416,980 | 5/1995 | Ilvespaa | 34/117 |
| 5,515,619 | 5/1996 | Kahl et al. | 34/117 X |
| 5,555,638 | 9/1996 | Lehosvuo et al. | 34/117 |
| 5,771,603 | 6/1998 | Kotitschke et al. | 34/446 |
| 5,782,009 | 7/1998 | Kotitschke et al. | 34/117 |
| 5,830,275 | 11/1998 | Reich . | |
| 5,860,223 | 1/1999 | Kahl | 34/117 |
| 5,862,613 | 1/1999 | Kerttula et al. | 34/446 |
| 5,864,965 | 2/1999 | Hansson et al. | 34/446 |
| 5,884,415 | 3/1999 | Sims et al. | 34/117 |
| 5,913,587 | 6/1999 | Kuhasalo et al. | 34/117 |
| 5,983,523 | 11/1999 | Ijas et al. | 34/445 |

FOREIGN PATENT DOCUMENTS

| | | |
|---|---|---|
| 3630571 | 3/1987 | Germany . |
| 4241400 | 6/1993 | Germany . |
| 296 16 569 U | 2/1997 | Germany . |
| 295 21 501 U | 7/1997 | Germany . |
| 95/30795 | 11/1995 | WIPO . |

*Primary Examiner*—Stephen Gravini
*Attorney, Agent, or Firm*—Greenblum & Bernstein, P.L.C.

[57] ABSTRACT

Drying section of a machine for producing a material web, such as a paper or cardboard web, comprises at least one drying group having at least one drying cylinder and at least one web guidance device around which the material web is guided in a meandering manner. The shrinkage gradient that occurs in the material web transversely with respect to the direction in which the web travels is set or controlled by providing at least one, and preferably several, areas in which an at least mostly free, unhindered shrinkage of the material web is possible.

39 Claims, 2 Drawing Sheets

DRYING SECTION AND METHOD FOR DRYING A MATERIAL WEB IN SUCH A DRYING SECTION

CROSS-REFERENCE TO RELATED APPLICATIONS

The present application claims priority under 35 U.S.C. § 119 of German Patent Application No. 198 05 723.7, filed on Feb. 12, 1998.

BACKGROUND OF THE INVENTION

1. Field of the Invention

The invention relates to a drying section of a machine for producing a material web, for example, a paper or cardboard web, and to methods of drying a material web in such a drying section, wherein the drying section comprises at least one drying group with at least one drying cylinder and comprises at least one web guidance device around which the material web is guided in a meandering manner. The invention further relates, in some aspects, to a roll that can be used particularly as a web guidance device in such a drying section.

2. Discussion of Background Information

Drying sections of the type specified above are known. They comprise a number of drying cylinders and web guidance devices, usually web guidance rolls, around which the material web is guided in a meandering manner. Preferably, the material web is firmly clamped between a transport or traveling screen and the drying cylinders in the area of the drying cylinders. In the area of the web guidance devices, the web is commonly fixed to the transport or traveling screen by means of a vacuum. This allows for runability in the drying section; however, shrinkage of the material web is hindered. Moreover, the steep shrinkage gradients at the edges, caused by shrinkage-hindered drying, lead to thicker edges with a rougher surface. This leads to problems during subsequent processing of the material web, for example in coating groups, printing machines, etc. Providing open sectioning points between the various drying groups is already known, as is reducing or switching off the vacuum, whereby the material web is less strongly fixed in position by lengths, and can shrink. The problems specified above, however, are not solved as desired in this manner.

In a drying section of the type specified above as disclosed in German patent document DE-U-296 16 569.7, several web guidance devices are respectively structured so that a gaseous medium can be supplied in several zones in sequence along the direction in which the web travels, in order to increase moisture removal from the web by blowing a gaseous medium on the material web, and thus to ensure more effective drying of the material web. However, in this drying section, the conveyor belt is removed from the material web before the material web winds onto the first web guidance device in the direction in which the web travels and before the material web is wound onto several subsequent web guidance devices, and is brought back together with the belt only after the material web reels off from the respective web guidance device. This entails problems particularly at the start of the drying section, where the strength of the wet web is still relatively low, which hinder the highest possible runability that is sought.

SUMMARY OF THE INVENTION

The invention provides methods of drying a web, as well as drying sections of the type specified above, to ensure as even a transverse shrinkage of the material web as possible, while also providing high runability, and avoiding steep shrinkage gradients at the edges of the web.

Additionally, the invention provides a roll that is particularly suitable as a web guidance device for such a drying section.

With respect to methods of the invention, these advantages are achieved according to the invention in that the shrinkage gradient, that occurs in the material web transversely with respect to the direction in which the web travels, is set or controlled in that at least one, and preferably several, areas are provided in which respectively an at least mostly free, unhindered shrinkage of the material web is possible. As the number of areas of free, unhindered shrinkage increase, the total shrinkage of the web increases, and the shrinkage gradient at the edge becomes flatter.

The transverse shrinkage gradient is thereby preferably controlled and/or regulated through the number of areas of free shrinkage and/or their position within the drying section.

In so doing, it must be taken into account that the shrinkage gradient improves as the number of selected areas of free, unhindered shrinkage increases; however, the maximum number must also be selected as a function of the desired runability so that a desired shrinkage gradient is not achieved at the expense of a desired degree of run ability.

In an advantageous practical embodiment, at least in one area to the rear (i.e., downstream), when viewed in the direction in which the web travels, of at least one drying group, an area of free shrinkage is provided. In this manner, the fact that the potential for influencing the web is greater at the end of each respective drying group as the respective downstream drying group has a higher running speed, is taken advantageously into account.

Advantageously, at least in one area of the drying section downstream, when viewed in the direction in which the web travels, at least one area of free shrinkage is provided, which is of particular advantage in light of the increased strength of the web at the end of the drying section.

In a preferred practical embodiment, the transverse shrinkage gradient is controlled or regulated so that, particularly also at the edges of the web, an at least mainly flat shrinkage gradient occurs when viewed transversely with respect to the direction in which the web travels.

With regard to the drying section, the advantages of the invention are achieved in that the shrinkage gradient occurring in the material web transversely with respect to the direction in which the web travels can be set by creating at least one, preferably several, areas in which an at least mainly free, unhindered shrinkage of the material web is possible.

In a preferred practical embodiment of the drying section according to the invention, the material web is continuously supported at least in an initial area of the drying section by a traveling screen and thereby is also guided around at least the first web guidance device when viewed in the direction in which the web travels, together with the traveling screen, whereby it is guided without contact around at least one web guidance device on a blanket of a gaseous medium and/or is impinged upon by a gaseous medium, at least at one location, by blowing from the traveling screen side, in order respectively to provide an area in which an at least mainly free, unhindered shrinkage of the material web is possible.

Relatively high runability is achieved once the material web is supported continuously by a traveling screen, particularly in the critical initial area of the drying section in which the strength of the wet web is still generally relatively low. Through the areas of free, unhindered shrinkage, the total shrinkage increases, whereby the shrinkage gradient at the edges is significantly flatter.

The number of areas of free shrinkage and/or their position within the drying section is, therefore, selected in such a manner that, particularly also at the edges of the web, an at least mainly or essentially flat shrinkage gradient occurs when viewed transversely with respect to the direction in which the web travels. Shrinkage is thus controlled by the number of areas of free shrinkage and/or their position. Such areas can be installed along the entire drying section. As before, relatively high runability can be ensured in this manner.

It is of particular advantage in the present invention that the drying section be formed by at least one single-row drying group, and preferably, is designed entirely as a single-row drying section. The single-row drying groups or the single-row drying section can be felted at top and bottom.

In an advantageous practical embodiment of the drying section according to the invention, at least one web guidance device is formed by a perforated roll that can be used as a blower roll for creating a blanket of a gaseous medium. Once the material web that has been guided around such a perforated roll floats on the generated blanket of a gaseous medium, such as air for example, the web can shrink unhindered in that area.

It is advantageous if the perforated roll can be switched between a blowing operation and a suction operation at least in an edge zone provided in the area of one of the two ends of the roll. In an advantageous practical embodiment, it can be switched between a blowing operation and a suction operation across its entire width.

In some embodiments, at least one stationary web guidance device is provided, around which the material web is guided on a blanket of a gaseous medium, without contact, which is referred to herein as an "air turn". Such an air turn can be provided in particularly preferred embodiments with corresponding blowing zones.

Providing at least one transition zone for the material web, e.g. a suction zone, is possible in the area of each respective web guidance device, in the relevant edge area.

Advantageously, at least one float dryer is provided. In this way, the material web may be supported alternately on both sides by a hot gas stream, for example, hot air.

In an advantageous embodiment, the material web is impinged upon in at least one location between a drying cylinder and a web guidance device by blowing a gaseous medium from the traveling screen side.

If several drying groups are provided, it is also possible, for example, to provide an open sectioning point between at least two drying groups. This can be advantageous, for example, at higher basis weights of the respective material web.

The roll according to the invention preferably comprises a perforated roll jacket and a main zone that can be connected to a hydraulic fluid source, as well as an edge zone comprising an area of one of the two ends of the roll, and at least the edge zone can be connected optionally to a hydraulic fluid source or a vacuum source.

Such a perforated roll is suitable with particular advantage as a web guidance device for the drying section according to the invention.

The main zone can also be selectively connected to a hydraulic fluid source or to a vacuum source.

In the perforated rolls of the invention, advantageously, a separation wall is provided between the main zone and the edge zone, which has at least one opening that can be closed, through which the edge zone can be connected to the main zone.

In an advantageous practical embodiment, a closing element structured preferably as a slide is provided, through which, optionally, either the opening leading to the main zone or a connection opening leading preferably to a vacuum source can be closed, whereby in the two end positions of this closing element, respectively, one of the two openings is closed and the other is opened.

In other aspects, a method of drying material web in a drying section of a machine for producing a material web is provided, wherein the drying section employed comprises at least one drying group having at least one drying cylinder and at least one web guidance device around which the material web is guided in a meandering manner; the method comprising providing at least one area in which the material web is allowed substantially free unhindered shrinkage such that the shrinkage gradient that occurs in the material web transversely with respect to the direction in which the web travels is controlled.

In some embodiments, the transverse shrinkage gradient is controlled by selecting the number and/or position of areas of free shrinkage within the drying section. Also, in some embodiments, at least in one area of free shrinkage downstream, in the direction in which the web travels, of at least one drying group is provided. Preferably, at least one area of free shrinkage downstream, in the direction in which the web travels, of the drying section is provided.

In methods according to the invention, an essentially flat shrinkage gradient occurs when viewed transversely with respect to the direction in which the web travels. Advantageously, an essentially flat shrinkage gradient preferably occurs at the edges of the web.

Preferably, the web is a paper or cardboard web.

In other aspects, the invention provides a drying section of a machine for producing a material web, having at least one drying group that comprises at least one drying cylinder and at least one web guidance device, around which the material web is guided in a meandering manner, and at least one area in which an at least mostly free, unhindered shrinkage of the material web is possible, so as to control the shrinkage gradient that occurs in the material web in the direction transverse with respect to the direction in which the web travels.

In some embodiments, the drying section comprises a traveling screen which supports the material web substantially continuously in at least an initial area of the drying section to thereby guide the web around at least a first web guidance device when viewed in the direction in which the web travels together with the traveling screen, and a source of gaseous medium to provide a blanket of gaseous medium wherein the material web is guided without contact around at least one web guidance device on the blanket of gaseous medium in order to provide an area in which an at least mainly free, unhindered shrinkage of the material web is possible.

In some embodiments, the material web comprises a traveling screen side and the material web is impinged upon by a gaseous medium, at least at one location, by blowing the gaseous medium from a traveling screen side of the web. Also in some embodiments, the material web is impinged upon by blowing of a gaseous medium from the traveling screen side in at least one location situated between a drying cylinder and a web guidance device.

The number and/or positions of areas of free shrinkage within the drying section is selected in such a manner that an essentially flat shrinkage gradient occurs when viewed transversely with respect to the direction in which the web travels. In some embodiments, this results in an essentially flat shrinkage gradient at the edges of the web.

In some embodiments, the drying section comprises at least one single-row drying group, and/or at least one single-row drying section.

At least one web guidance device which comprises a perforated roll that can be used as a blower roll for creating a blanket of a gaseous medium is preferably provided, and preferably, the perforated roll is constructed and arranged to be switched between blowing operation and suction operation in at least an edge zone in an area of a first or second end of the roll. Also in some embodiments, the perforated roll is constructed and arranged to be switched between a blowing operation and a suction operation across its entire width, and in some embodiments, the perforated roll comprises a main zone that can be connected to a hydraulic fluid source, and an edge zone comprising an area of one of a first or second end of the roll, and wherein at least the edge zone can be selectively connected to a hydraulic fluid source or a vacuum source. The main zone also can be selectively connected to a hydraulic fluid source or to a vacuum source. Thus, the perforated roll can comprise a separation wall disposed between the main zone and the edge zone, the separation wall having at least one closable opening, through which the edge zone can be connected with the main zone. In some embodiments, a closing element structured as a slide is provided, through which, either a first opening leading to a main zone or a second opening leading to a vacuum source can be closed selectively, whereby one of the first or second openings may be closed when the other is opened.

The drying section can comprise at least one stationary web guidance device around which the material web is guided on a blanket of a gaseous medium, without contact between the material web and the stationary guidance device. At least one web guidance device may be formed by a roll, the circumferential speed of which is greater than the web speed, the difference in speed being so large that an air blanket is created, on which the material web is guided around the roll.

The drying sections of the invention can comprise at least one float dryer.

The drying sections of the invention can comprise at least two drying groups and an open sectioning point between such at least two drying groups. In some embodiments, the material web is guided in the area of the open sectioning point without a traveling screen on a blanket of a gaseous medium around a stationary web guidance device, substantially without contacting the stationary web guidance device. In some embodiments, the material web is guided in the area of the open sectioning point without a traveling screen around a perforated roll that is constructed and arranged to be operated as a blower roll. The material web may, in some embodiments, be guided in the area of the open sectioning point around the perforated roll and the material web may be impinged upon by blowing of a gaseous medium between an upstream drying cylinder and the perforated roll and between the perforated roll and a downstream drying cylinder.

In some embodiments, at least one guide element supporting the material web is disposed between two areas of free shrinkage.

In other embodiments, the invention provides a roll for use as a web guidance device in a drying section, the roll having first and second ends, and comprising:

a perforated roll jacket;

a main zone that can be connected to a hydraulic fluid source; and an edge zone comprising an area of one of the first and second ends of the roll, at least one edge zone being constructed and arranged to be selectively connected to a hydraulic fluid source or a vacuum source.

In certain embodiments of such a roll, the main zone may also be constructed and arranged to be selectively connected to either of a hydraulic fluid source or a vacuum source. Such a roll can comprise a separation wall disposed between the main zone and the edge zone, the separation wall comprising at least one opening that can be closed, through which the edge zone can be connected to the main zone. Such a roll can also comprise a closing element having first and second end positions by which either the opening leading to the main zone or a connection opening leading to a vacuum source can be selectively closed, whereby one of the two openings may be selectively closed while the other is opened.

In other method aspects the invention relates to a method of drying a material web in a drying section of a machine for producing a material web, the drying section comprising at least one drying group having at least one drying cylinder and at least one web guidance device, the method comprising:

introducing the material web to be dried into the drying section and passing the web around the web guidance device; and introducing the material web into an area downstream from the web guidance device, and allowing the material web to undergo drying in the area downstream from the web guidance device, under conditions wherein contact between the web and the web guidance device is reduced. In some embodiments, the contact between the web and the roll or web guidance device is reduced by introducing a gaseous stream between the web and the web guidance device. In some embodiments, the web guidance device is a perforated roll and the gaseous stream is introduced through perforations in the roller. In other embodiments, the web guidance device is a nonrotating web guidance device comprising air passages and the gaseous stream is introduced through the air passages. In some embodiments, the drying cylinder has a first rotational speed and the web guidance device has a second rotational speed and the difference between the first rotational speed of the drying cylinder and the second rotational speed of the web guidance device is sufficient to create a blanket of gaseous medium between the web and the web guidance device sufficient to reduce contact between the web and the web guidance device.

In other apparatus aspects the invention provides a drying section of a machine for producing a material web, having it least one drying group comprising at least one drying cylinder and at least one web guidance device around which the material web is guided in a meandering manner;

an area downstream from the web guidance device in which the web is subjected to drying without substantial contact with a roll or guidance device, so as to control a shrinkage gradient that occurs in the material web in the direction transverse with respect to the direction in which the material web travels. In some embodiment, the web guidance device comprises at least one member selected from the group consisting of a passageway or a perforation or combinations thereof, which introduces a gaseous stream between the web and a roll or guidance device. In some embodiments, the web guidance device comprises a perforated roll. In some embodiments, the web guidance device comprises a non-rotating web guidance device comprising a passageway through which a gaseous medium may flow.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
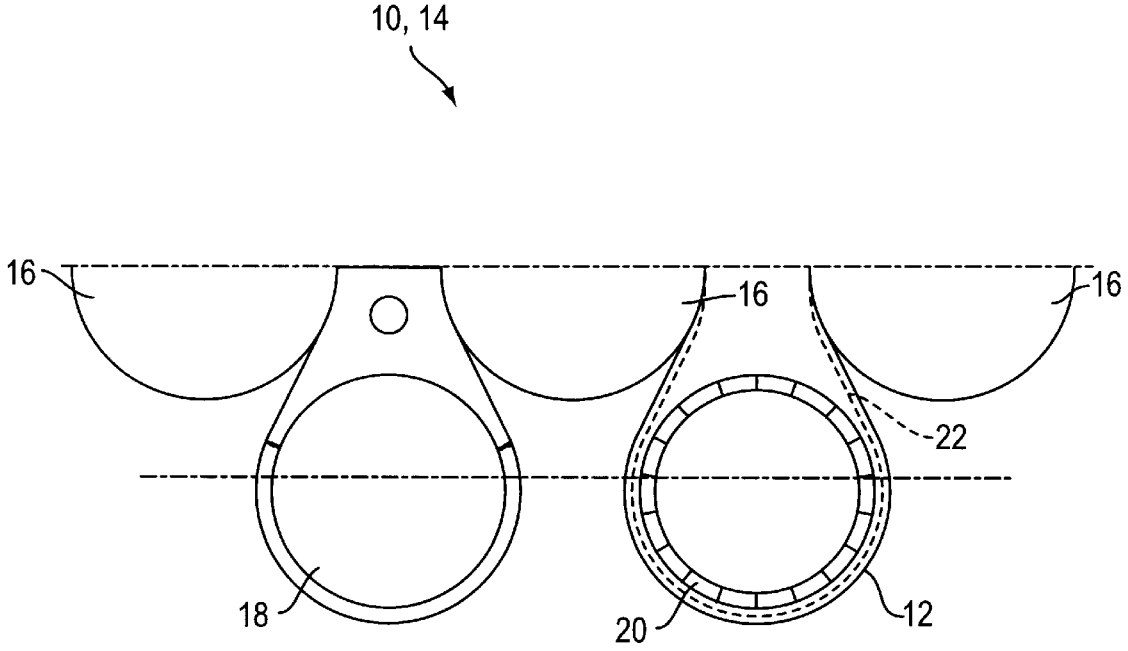
FIG. 1 is a schematic representation of an embodiment of a drying section of a machine for producing a paper web.

FIG. 1 is a schematic partial representation of a drying section 10 of a machine for producing a material web (such as a cardboard or paper web), here for purposes of illustration, a paper web 12, with at least one drying group 14 that comprises several drying cylinders 16 and several web guidance devices 18, 20. In this arrangement, the paper web 12 is guided around the drying cylinders 16 and the web guidance device 18, 20 along with a traveling screen 22 in a meandering manner. In this exemplary embodiment, paper web 12 is guided around the drying cylinders 16 so that it lies between the cylinder and the traveling screen 22.

At least in the initial area of the drying section 10, the paper web 12 is supported by the traveling screen 22, whereby it is guided around the first web guidance device when viewed in the direction in which the web travels, together with this traveling screen 22.

The paper web 12 is thereby guided around at least one web guidance device on a blanket of a gaseous medium, without contact, and/or impinged upon in at least one location by blowing of a gaseous medium from the traveling screen side, in order thereby to create one area, respectively, in which an at least mainly free, unhindered shrinkage of the paper web 12 is possible.

In accordance with the invention, the number of areas of free shrinkage and/or their position within the drying section 10 is selected so that, particularly also at the edges of the web, an at least mainly flat shrinkage gradient occurs when viewed transversely with respect to the direction in which the web travels.

The drying section 10 can be formed by at least one single-row drying group 14. In certain embodiments, it is formed overall, or substantially entirely in some preferred embodiments, as a single-row drying section. The number and position of the areas of at least mainly free, unhindered shrinkage of the paper web 12 can be readily selected by those of ordinary skill in the art, based on and once enlightened by the teachings of the present specification.

In the exemplary embodiment represented, the web guidance device 18 is formed by a suction roll and the web guidance device 20 is formed by a perforated roll 20 described in further detail below, which can specifically be used as a blower roll, around which the paper web 12 is guided without contact on a blanket of a gaseous medium, particularly air, to create one area of at least mainly free, unhindered shrinkage of the paperweb 12.

Figure 2:
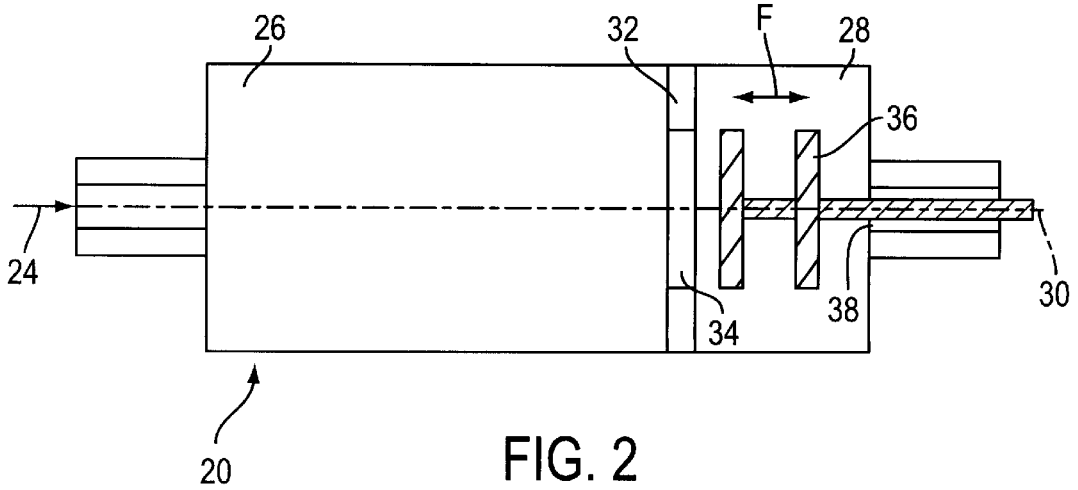
FIG. 2 is a schematic longitudinal section of the perforated roll used in the drying section according to FIG. 1.

As can be seen in FIG. 2, the perforated roll 20 of this embodiment comprises a main zone 26 that can be connected to a hydraulic fluid source 24, as well as an edge zone 28 located in the area of one of its two ends. In such embodiments where perforated roll 20 is employed to create a blanket of gaseous medium, the gaseous medium, such as air, is preferably introduced through fluid source 24 at the rate of, for example, from about 5 to about 50 cubic meters per minute per meter of width of the pressure portion of the roll. The edge zone 28 can be connected optionally via the main zone 26 to the hydraulic fluid source 24 or to a vacuum source 30, whereby it serves as a transition zone when connected to the vacuum source 30.

A separation wall 32 is preferably provided between the main zone 26 and the edge zone 28, which has a closable opening 34, through which the edge zone 28 is connected during blowing operation with the main zone 26 that is connected to the hydraulic fluid source 24. By contrast, this opening 34 is closed when the edge zone 28 is connected to the vacuum source 30. When a vacuum is employed a vacuum of from about 100 to about 1000 Pascal units is preferably employed.

In this regard, according to the present invention, a closing element 36 structured as a slide is provided, through which optionally either the opening 34 leading to the main zone 26 or a connection opening 38 creating a connection with the vacuum source 30 can be closed. In the two end positions of this slide-type closing element that is adjustable along the roll in the direction of the arrow F, one of the two openings 34, 38, respectively, is closed and the other is opened.

Thus, in accordance with other aspects of the invention, such a perforated roll is provided that can be switched between blowing operation and suction operation across its entire width and this can also be used. In some such embodiments, the communication with hydraulic fluid source 24 may also optionally be closed by a closing element, which element is otherwise conventional.

The drying section 10 can be formed by at least one single-row drying group 14, whereby it is structured overall as a single-row drying section 10. Alternately, or in addition to the use of a rotating blower roll 20, a stationary web guidance device can also be provided, around which the material web 12 is guided without contact on a blanket of a gaseous medium. Thus, the insertion of at least one float dryer is also contemplated, whereby, in this case, the paper web 12 is supported alternately on both sides by hot air, for example. Alternatively or in addition, the material web 12 can also be impinged upon by blowing of a gaseous medium from the traveling screen side in at least one location situated between a drying cylinder 16 and a web guidance device 18, 20. If several drying groups 14 are provided, it is also contemplated that an open sectioning point is provided between at least two drying groups 14, which can be advantageous, particularly at higher basis weights of the paper web.

In some embodiments, at least one guide element, particularly a drying cylinder or a guide roll, immediately supporting the material web 12 and, if applicable, a traveling screen 22 is provided between two areas of free shrinkage.

In this drying section 10, the shrinkage gradient that occurs in the material web 12 transversely with respect to the direction in which the web travels is controlled or adjusted in that at least one, preferably several, areas are created in which an at least mainly free, unhindered shrinkage of the material web 12 is possible, for example, by virtue of the fact that contact with a roll or similar device is minimized or substantially eliminated. Thereby, the transverse shrinkage gradient is controlled and/or regulated through the number of areas of free shrinkage and/or their position within the drying section. As discussed previously, the number and position of the areas of at least mainly free, unhindered shrinkage of the paper web 12 can be readily selected by those of ordinary skill in the art, based on and once enlightened by the teachings of the present specification.

Figure 3:
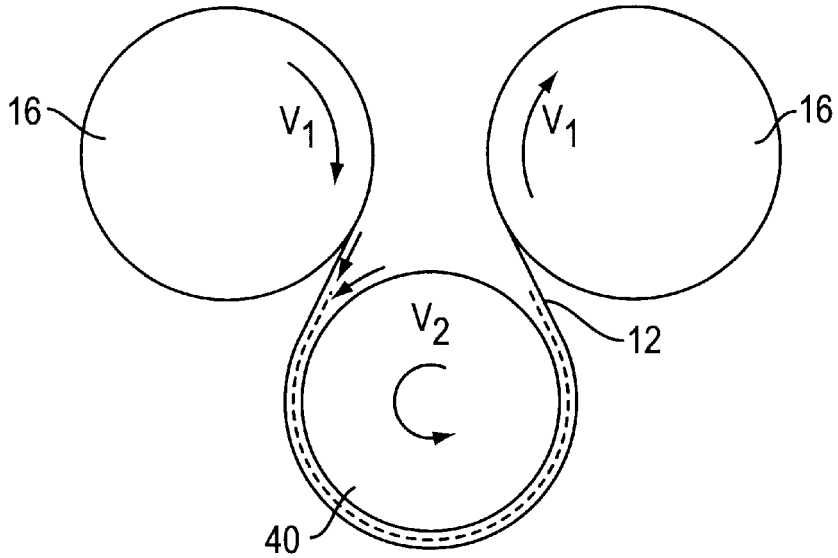
FIG. 3 is a schematic partial representation of a further embodiment of a drying section.

FIG. 3 is a schematic partial representation of a further exemplary embodiment of a drying section, in which at least one web guidance device is formed by a roll 40, the circumferential speed of which is greater than the web speed, whereby the difference in speed is selected to be so large that an air blanket is created, on which the material web 12 is guided around the roll 40. In the present case, the roll 40 is positioned between two drying cylinders 16 of essentially equal diameter, whereby the rotational speed $v_2$ of the roll 40 is significantly greater than the rotational speed v, of the two drying cylinders 16. In this case, as well, the air blowing operation is not excluded. Thus, a perforated roll that can be used particularly as a blower roll is utilized as the roll 40, for example. However, as will be appreciated by those of ordinary skill in the art after being enlightened by the present specification, it is not necessary that the air blown through the blower roll be used to create a blanket of gaseous medium, since in this embodiment the difference in rotational speed is primarily relied upon, as is discussed more fully below.

In embodiments where an air blanket is created by a difference in rotational speeds between roll 40 ($V_2$ ) and drying cylinders ($V_1$), such as drying cylinders 16, the speed difference is preferably selected so that $\Delta V \leqq \pm 0.5\% V$. In certain embodiments, such as those wherein the area of unhindered shrinkage is closer to the wet end of the drier section, the rotational speed of the downstream roll 40 ($V_2$) is higher than the rotational speed of an upstream drying cylinder 16 ($V_1$) (that is, the speed differential has a positive value), in order to maintain tension on the material web being dried, as will be appreciated by those of ordinary skill in the art, once enlightened by the present specification. However, the speed differential may have a negative value, if the area of unhindered shrinkage is closer to the dry end of the drier section. Additionally, if the material web being dried has reached a dryness value of at least about 60%, the speed differential may have a negative value in order to account for and accommodate shrinkage of the web being dried. Additionally, at the dry end of the drier section, the speed differential may be selected to produce either a positive or negative value, depending on whether it is desired to create an air boundary layer or to accommodate shrinkage.

Figure 4:
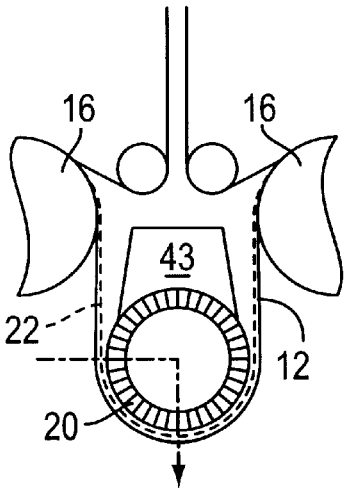
FIG. 4 is a schematic representation of a sectioning point provided between two drying groups of a further embodiment of a drying section; and, FIG. 5 is a schematic representation of a sectioning point provided between two drying groups of a further embodiment of a drying section.

Referring to FIG. 4, a schematic representation is shown of a sectioning point provided between two drying groups in a further embodiment of a drying section. In accordance with this embodiment of the invention, the material web 12 is guided in the area of the open sectioning point without a traveling screen around a perforated roll 20, which, in some embodiments, can be operated as a blower roll. In addition, the material web 12 is impinged upon by blowing of a gaseous medium between an upstream drying cylinder 16 and the perforated roll 20 and between the perforated roll 20 and a downstream drying cylinder 16 in the manner illustrated, which may include a blower box 43.

Figure 5:
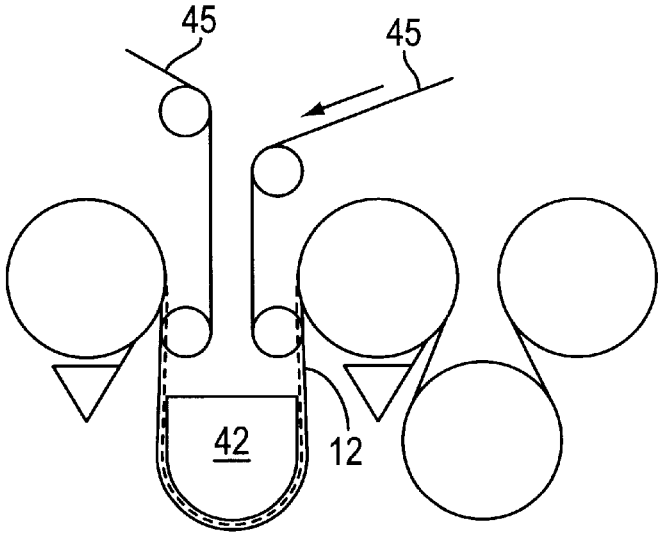

FIG. 5 is a schematic representation of a sectioning point provided between two drying groups of a further embodiment of a drying section. In this case, the material web 12 is guided in the area of the open sectioning point without a traveling screen on a blanket of a gaseous medium, without contact, around a stationary (i.e., non-rotating) web guidance device 42. In this regard, separate web guidance systems 45, such as traveling screens, transport belts or dryer felts are employed which, as shown do not extend around stationary web guidance device 42. The stationary web guidance device thus preferably is provided with at least one passageway, such as air passages, which may be configured similarly to the perforations in the perforated 20. Construction and arrangement of the air passages can be readily selected by those of ordinary skill in the art, once enlightened by the present specification.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A method of drying a material web in a drying section of a machine for producing a material web, the drying section comprising at least one drying group having at least one drying cylinder and at least one web guidance device around which the material web is guided in a meandering manner;

the method comprising providing at least one area in which the material web is allowed substantially free unhindered shrinkage such that the shrinkage gradient that occurs in the material web transversely with respect to the direction in which the web travels is controlled.

2. The method of claim 1, comprising selecting at least one of the number or position of areas of free shrinkage within the drying section to control the shrinkage gradient that occurs in the material web transversely with respect to the direction in which the web travels.

3. The method of claim 1, comprising providing at least in one area of free shrinkage downstream, in the direction in which the web travels, of at least one drying.

4. The method of claim 1, comprising providing at least one area of free shrinkage downstream, in the direction in which the web travels, of the drying section.

5. The method of claim I, wherein an essentially flat shrinkage gradient occurs when viewed transversely with respect to the direction in which the web travels.

6. The method of claim 5, wherein an essentially flat shrinkage gradient occurs at the edges of the web.

7. The method of claim 1, wherein the web is a paper or cardboard web.

8. A drying section of a machine for producing a material web, having at least one drying group that comprises at least one drying cylinder and at least one web guidance device, around which the material web is guided in a meandering manner, and at least one area in which an at least mostly free, unhindered shrinkage of the material web is possible, so as to control the shrinkage gradient that occurs in the material web in the direction transverse with respect to the direction in which the web travels, wherein the material web is guided without contact around at least one web guidance device to provide an area in which an at least mainly free, unhindered shrinkage of the material web is possible.

9. The drying section of claim 8, comprising a traveling screen which supports the material web substantially continuously in at least an initial area of the drying section to thereby guide the web around at least a first web guidance device when viewed in the direction in which the web travels together with the traveling screen, and a source of gaseous medium to provide a blanket of gaseous medium wherein the material web is guided without contact around at least one web guidance device on the blanket of gaseous medium in order to provide an area in which an at least mainly free, unhindered shrinkage of the material web is possible.

10. The drying section of claim 9, wherein the material web comprises a traveling screen side and said material web is impinged upon by a gaseous medium, at least at one location, by blowing said gaseous medium from a traveling screen side of the web.

11. The drying section of claim 10, wherein said material web is impinged upon by blowing of a gaseous medium from the traveling screen side in at least one location situated between a drying cylinder and a web guidance device.

12. The drying section of claim 8, wherein at least one of the number or position of areas of free shrinkage within the drying section is selected in such a manner that an essentially flat shrinkage gradient occurs when viewed transversely with respect to the direction in which the web travels.

13. The drying section of claim 12, wherein an essentially flat shrinkage gradient occurs at the edges of the web.

14. The drying, section of claim 8, comprising at least one single-row drying group.

15. The drying section claim 8, comprising at least one single-row drying section.

16. The drying section of claim 8, wherein at least one web guidance device comprises a perforated roll that can be used as a blower roll for creating a blanket of a gaseous medium.

17. The drying section of claim 16, wherein the perforated row is constructed and arranged to be switched between blowing operation and suction operation in at least an edge zone in an area of a first or second end of the roll.

18. The drying section of claim 17, wherein the perforated roll is constructed and arranged to be switched between a blowing operation and a suction operation across its entire width.

19. The drying section claim 18, wherein the perforated roll comprises a main zone that can be connected to a hydraulic fluid source, and an edge zone comprising an area of one of a first or second end of the roll, and wherein at least the edge zone can be selectively connected to a hydraulic fluid source or a vacuum source.

20. The drying section of claim 19, wherein the main zone also can be selectively connected to a hydraulic fluid source or to a vacuum source.

21. The drying section of claim 19, comprising a separation wall disposed between the main zone and the edge zone, the separation wall having at least one closable opening, through which the edge zone can be connected with the main zone.

22. The drying section of claim 21, wherein a closing element structured as a slide is provided, through which, either a first opening leading to a main zone or a second opening leading to a vacuum source can be closed selectively, whereby one of the first or second openings may be closed when the other is opened.

23. The drying section of claim 8, comprising at least one stationary web guidance device around which the material web is guided on a blanket of a gaseous medium, without contact between the material web and the stationary guidance device.

24. The drying section of claim 8, wherein at least one web guidance device is formed by a roll, the circumferential speed of which is greater than the web speed, the difference in speed is so large that an air blanket is created, on which the material web is guided around the roll.

25. The drying section of claim 8, comprising at least one float dryer.

26. The drying section of claim 8, comprising at least two drying groups and an open sectioning point between said at least two drying groups.

27. The drying section of claim 26, wherein the material web is guided in the area of the open sectioning point without a traveling screen on a blanket of a gaseous medium around a stationary web guidance device, substantially without contacting the stationary web guidance device.

28. The drying section of claim 26, wherein the material web is guided in the area of the open sectioning point without a traveling screen around a perforated roll that is constructed and arranged to be operated as a blower roll.

29. The drying section of claim 28, wherein the material web is guided in the area of the open sectioning point around the perforated roll and wherein the material web is impinged upon by blowing of a gaseous medium between an upstream drying cylinder and the perforated roll and between the perforated roll and a downstream drying cylinder.

30. The drying section of claim 8 wherein, at least one guide element supporting the material web is disposed between two areas of free shrinkage.

31. A method of drying a material web in a drying section of a machine for producing a material web, said drying section comprising at least one drying group having at least one drying cylinder and at least one web guidance device, the method comprising:

introducing said material web to be dried into the drying section and passing said web around said web guidance device; and introducing said material web into an area downstream from said web guidance device, and allowing said material web to undergo drying in said area downstream from said web guidance device, under conditions wherein contact between said web and said web guidance device is reduced.

32. The method of claim 31, wherein the contact between said web and said roll or web guidance device is reduced by introducing a gaseous stream between said web and said web guidance device.

33. The method of claim 32, wherein said web guidance device is a perforated roll and said gaseous stream is introduced through perforations in said roller.

34. The method of claim 32, wherein said web guidance device comprises a non-rotating web guidance device comprising air passages and said gaseous stream is introduced through said air passages.

35. The method of claim 31, wherein said drying cylinder has a first rotational speed and said web guidance device has a second rotational speed and the difference between the first rotational speed of the drying cylinder and the second rotational speed of the web guidance device is sufficient to create a blanket of gaseous medium between said web and said web guidance device sufficient to reduce contact between said web and said web guidance device.

36. A drying section of a machine for producing a material web, having at least one drying group comprising at least one drying cylinder and at least one web guidance device around which the material web is guided in a meandering manner;

an area downstream from said web guidance device in which said web is subjected to drying without substantial contact with a roll or guidance device, so as to control a shrinkage gradient that occurs in the material web in the direction transverse with respect to the direction in which the material web travels, wherein the material web is guided without contact around at least one web guidance device to provide an area in which an at least mainly free, unhindered shrinkage of the material web is possible.

37. The drying section of claim 36, comprising at least one member selected from the group consisting of a passageway or a perforation or combinations thereof, which introduces a gaseous stream between said web and a roll or guidance device.

38. The drying section of claim 37, wherein said web guidance device comprises a perforated roll.

39. The drying section of claim 37, wherein said web guidance device is a non-rotating web guidance device comprising a passageway through which a gaseous medium may flow.

* * * * *